United States Patent [19]

Dunn et al.

[11] 4,095,541

[45] Jun. 20, 1978

[54] SEWING MACHINE LUBRICATION

[75] Inventors: Earl Francis Dunn, Edison; Adolph Armer Gebhardt, Chatham, both of N.J.

[73] Assignee: The Singer Company, New York, N.Y.

[21] Appl. No.: 787,734

[22] Filed: Apr. 14, 1977

[51] Int. Cl.[2] ..... D05B 71/00

[52] U.S. Cl. ..... 112/256

[58] Field of Search ..... 112/256; 184/69, 6.15

[56] References Cited

U.S. PATENT DOCUMENTS

| | | | |
|---|---|---|---|
| 1,255,088 | 1/1918 | Frederick | 184/69 |
| 2,386,349 | 10/1945 | Sauer | 112/256 |
| 2,430,369 | 11/1947 | Sauer | 112/256 |
| 3,254,740 | 6/1966 | Bono | 112/256 X |

*Primary Examiner*—George H. Krizmanich

*Attorney, Agent, or Firm*—Robert E. Smith; Edward L. Bell; Alan Ruderman

[57] ABSTRACT

A sewing machine having a modular oil reservoir attached to the frame and having a wick disposed above the lubricant level with one end abutting a wall of the reservoir and relies for its wetting upon the vibratory action of the machine during its operation. Normal machine operating vibration causes the lubricant to wet the walls of the reservoir and through capillary action the wick is wetted to supply lubricant to the needle bar and take up mechanism. This serves to supply relatively small but sufficient quantity of lubricant for lubricating purposes and when the machine is shut off, since the wick is not immersed in lubricant, no lubricant is fed through the system.

6 Claims, 3 Drawing Figures

SEWING MACHINE LUBRICATION

BACKGROUND OF THE INVENTION

This invention relates to sewing machine lubrication and more particularly to a lubrication system controlling the flow of lubricant to the operating mechanism during the operation of the machine and for terminating the flow of lubricant when the machine is stopped.

For some time the sewing machine industry has been concerned with the problem of lubricating the moving parts of high speed machines with a system for delivering a predetermined quantity of lubricant during operation and for terminating the flow of lubricant when the sewing machine is stopped. It is known in these high speed machines to utilize a wicking for feeding lubricant from a reservoir to the moving parts of the machine. In many of the prior art sewing machines a wicking was disposed within the lubricant and through capillary action lubricant was fed to the moving part. However, this arrangement was found unsatisfactory since oil was continuously fed through the absorption process and capillary action from the reservoir to the moving parts in the head of the machine even while the machine was inoperative. Thus, if a machine was allowed to sit inoperative for a period of time the reservoir would be drained dry and the oil pan in the bed of the machine would overflow with oil.

In an attempt to overcome these disadvantages the prior art developed a number of proposals by which the wick was wetted by a positive action through a plunger or a vibratory spring member which brought the wick into contact with the oil. Systems of this type are illustrated in Parry et al., U.S. Pat. No. 2,771,965 and Ross, U.S. Pat. No. 3,011,592. Another proposal in which the wick is wetted through capillary action but which requires a manual action through a plunger mechanism to cause oil to flow into a tube wherein capillary action will cause the wick to be wetted is illustrated in Japanese Utility Model Registration No. 481,381 dated Aug. 23, 1958.

SUMMARY OF THE INVENTION

It has now been discovered that normal sewing machine operating vibration causes the lubricant in a reservoir in the frame to ride up the wall of the reservoir by capillary action. This phenomenon is believed to be the result of surface tension of the lubricant. The present invention utilizes this principle by placing a wick in the reservoir above the normal level of the lubricant in abutting relation with the wall at one end. The wick is directed through the reservoir to bearing surfaces of the operating mechanism and when the lubricant touches the one end of the wick the wick absorbs and transmits the lubricant to the bearing surfaces to supply and meter relatively small but sufficient oil for lubricating purposes. When the machine is shut off, no oil is fed through the system since the wick is not immersed in or wetted by the lubricant.

It is therefore a primary object of the present invention to provide a lubrication system for a sewing machine having a lubricant reservoir maintaining lubricant at an intermediate level and having a wick with one end abutting a wall of the reservoir above the lubricant level and directed at its other end through the reservoir to distribution points in the operating mechanism which provide normal operating vibrations that cause lubricant to flow up the wall by capillary action to wet the wick.

BRIEF DESCRIPTION OF THE DRAWINGS

Other objects and advantages of this invention will best be understood upon reading the following detailed description of the invention with the accompanying drawings, in which.

DETAILED DESCRIPTION OF THE PREFERRED EMBODIMENT

Figure 1:
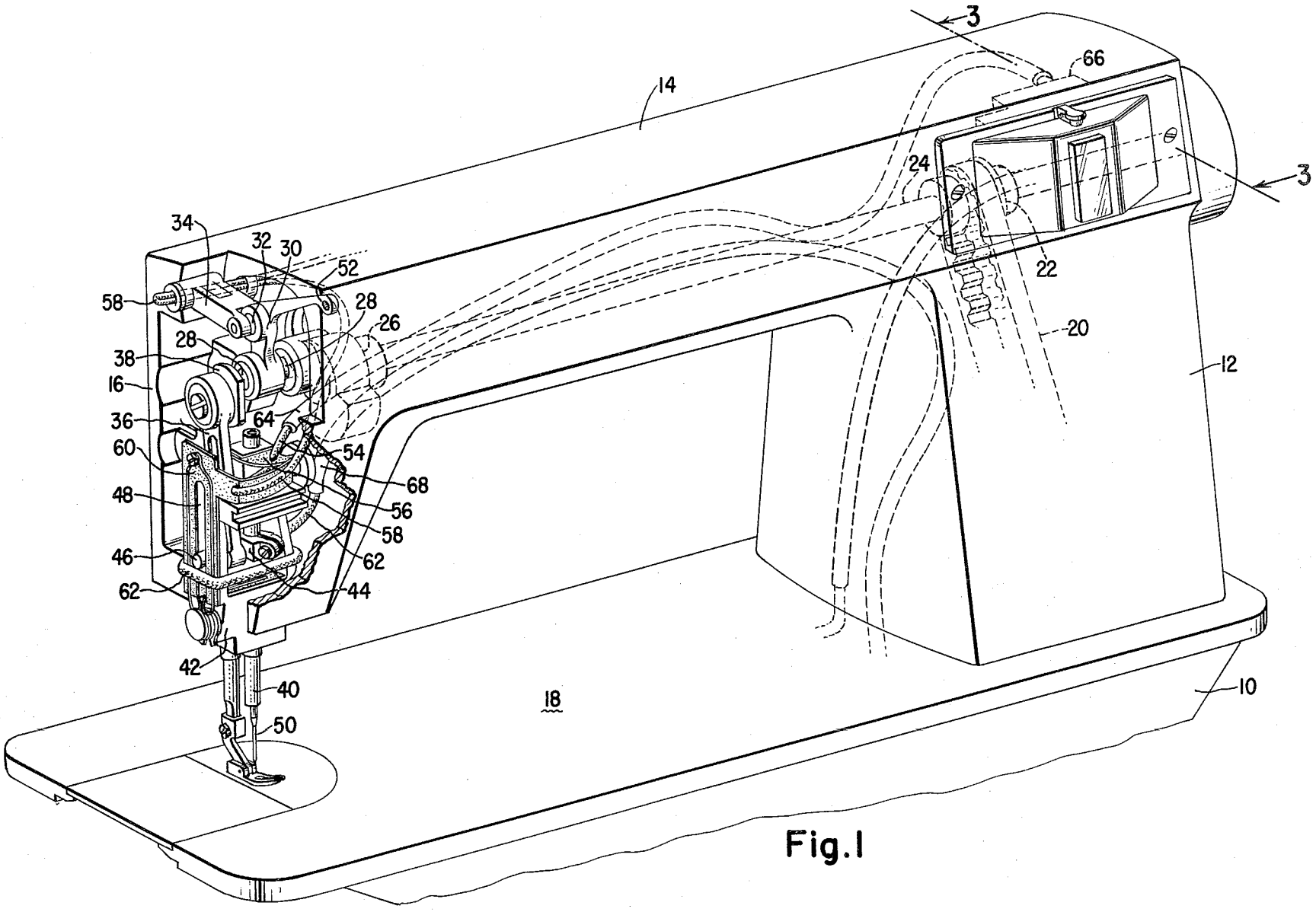
FIG. 1 is a perspective view of a portion of a sewing machine incorporating the novel lubricating system of the present invention with parts of the machine broken away and in phantom.
Figure 2:
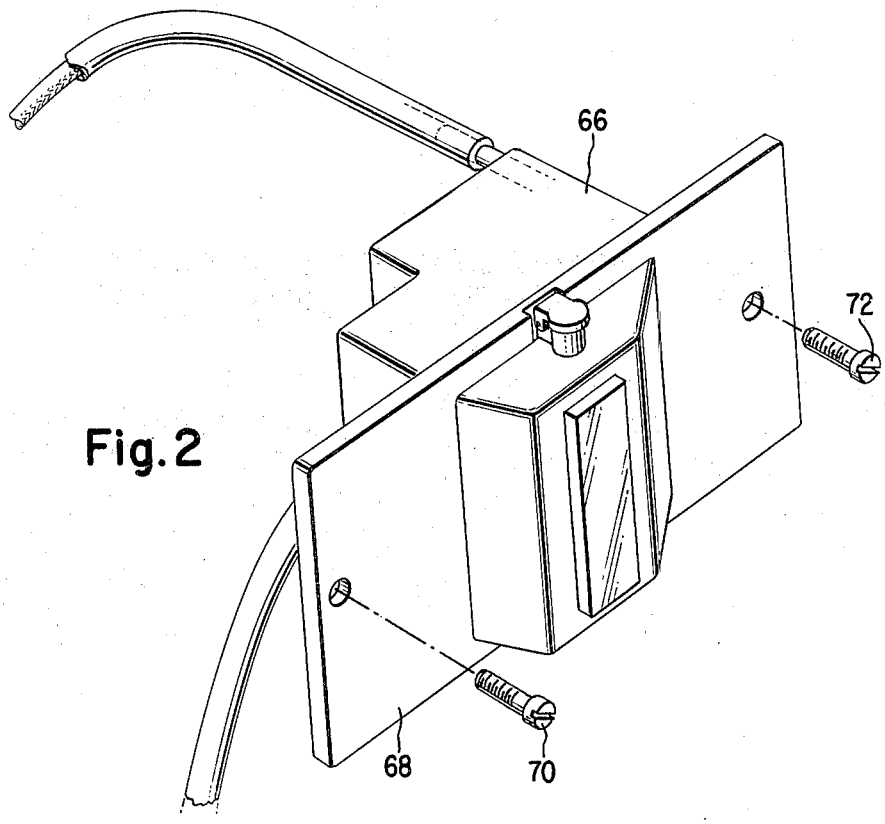
FIG. 2 is a perspective view of the lubricant reservoir illustrated in FIG. 1 removed from the machine.
Figure 3:
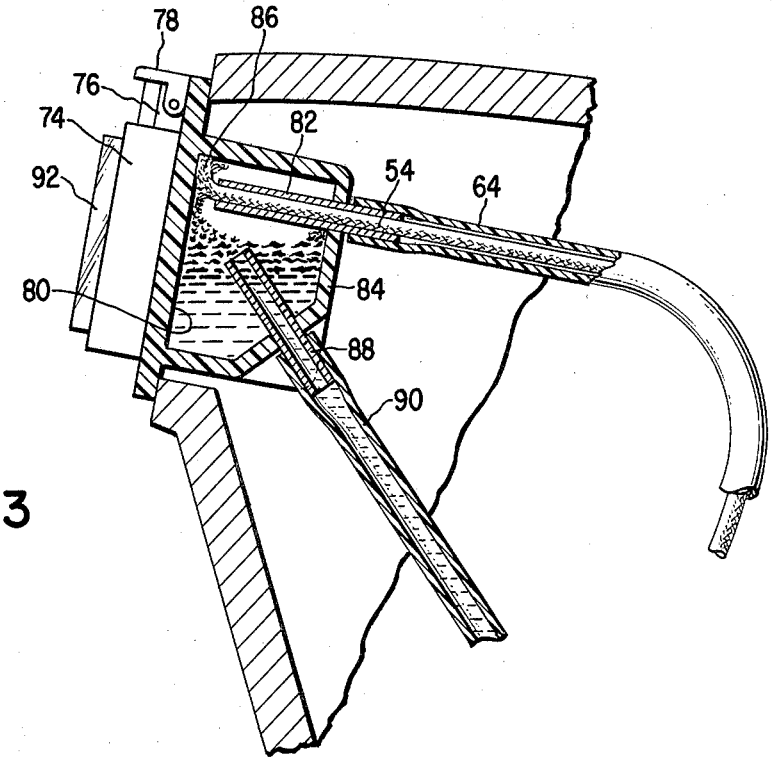
FIG. 3 is a fragmentary cross-sectional view through the reservoir taken substantially along line 3—3 of FIG. 1 and illustrating the adhesion between the lubricant and the reservoir wall which results in capillary flow of lubricant up the wall to the wick during normal operation of the sewing machine.

Referring to the drawings FIG. 1 illustrates a sewing machine having a frame comprising a bed 10, a standard 12 upstanding from the bed and integral with an arm 14 overlaying the bed and terminating in a sewing head 16 spaced above the work support surface 18 of the bed. A power drive means (not illustrated) conventionally drives the operating mechanism of the sewing machine through a timing belt 20 trained about a pulley 22 carried on an arm shaft 24 rotatably journalled longitudinally in the arm of the machine. Fast on the arm shaft 24 in the head end of the machine is a crank 26 which eccentrically supports a crank pin 28. A take up lever 30 is journalled at one end on the pin 28 and at an intermediate point is journalled on a pin 32 carried by an arm 34 pivotably supported in the upper portion of the rear of the head. A needle bar driving link 36 is pivotably mounted on an arm 38 eccentrically carried by the crank pin 28. A needle bar 40 is carried within a needle bar frame 42 supported in the head of the machine and includes a clamping arm 44 having a pin 46 journalled in a bore of the driving link 36 and constrained within a vertical slot 48 formed in the needle bar frame. Thus, as the arm shaft is rotatably driven the take up lever 30 and the needle bar 40 are driven in timed relation thereto. A needle 50 is carried in the needle bar and conventionally carries thread (not illustrated) fed through an eye 52 of the take up arm to cooperate with a bobbin thread carried in a hook (not illustrated) in the bed of the machine to conventionally form stitches.

The critical operating parts of the machine are lubricated by means of oil absorbent wicks such as the wick 54 that lubricates the needle bar through a felt pad 56 and a wick 58 that lubricates the rear pivot pin of the take up arm 34. Felting 60 is disposed against the wall of the needle bar frame in the vicinity of the slot 48 to catch the excess lubrication from the wick 54. The wick 58 is disposed against the felting 60 and by absorption and capillary action transmits the lubricant to the take up pin, while another wick 62 engages the felting 60 to return the excess lubrication to an oil pan in the bed. The wicks are disposed within plastic tubes such as 64 and directed across the arm 14 of the machine to a reservoir 66 while the wick 62 is carried within a plastic tube 68 to the bed.

The reservoir 66 is preferably formed as an integral modular unit from a synthetic plastic material and includes a front flange mounting portion 68 which is secured by means of screws 70 and 72 to the arm of the frame of the machine. The reservoir includes a filler portion 74 having a filler port 76 communicating with the interior cavity thereof and a cap 78 pivotably mounted on the filler port. The interior of the cavity of the reservoir includes an upstanding wall 80 which may be inclined from the vertical to aid the capillary action. A tube 82 preferably brass is secured to the back wall 84 of the reservoir substantially normal thereto and extends in the direction of the front wall 80 and out the back wall. The plastic tube 64 frictionally concentrically receives the tube 82 and the wick 54 is drawn through the tube 82. The leading edge 86 of the wick 54 is disposed in abutting relation against the wall 80 and turned upwardly. In the preferred embodiment another brass tube 88 is angularly disposed downwardly adjacent the bottom porton of the reservoir and carries a plastic tube 90 downwardly into the bed for supplying lubricant to the mechanism therein.

It has been found that when the reservoir is filled to an intermediate level above the upper extremity of the tube 88 but below the extremity 86 of the wick 54 the normal operating vibrations of the machine disturb the surface of the lubricant causing it to adhere to the wall 80 of the reservoir and by capillary action wet the wall at the location of the extremity 86 of the wick. During continuous operation wetting of the tip of the wick causes the wick to absorb the lubricant and by capillary action within the wick the lubricant flows to distribute lubricant to the critical operating mechanism. When the machine is stopped the lubricant in the reservoir settles to its natural level and no lubricant is transmitted to the wick. In the prior art the wick was disposed within the lubricant and continuously absorbed and transferred lubricant from the reservoir to the operating components while the machine was inoperative and thereby filled the bed and emptied the reservoir while the machine was sitting still. This disadvantage of the prior art is overcome by the present invention. The front of the filling portion 74 of the reservoir may comprise a transparent wall 92 through which the lubricant level can be viewed so that the level of the lubricant when filling can be maintained below the level of the wick.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a sewing machine having a frame including a bed, a standard upstanding from the bed, a bracket arm terminating in a head overlying said bed, said frame supporting operating mechanisms including a reciprocal needle bar and a take up mechanism in the head, an arm shaft rotatably journalled in said bracket arm for driving said needle bar and said take up mechanism, and means for rotating said shaft, said frame supporting said operating mechanism in such a way as to transmit normal operating vibratory forces thereto, the improvement comprising: a lubricate reservoir supported on the frame for receiving vibratory forces therefrom, said reservoir including a bottom surface and an upstanding wall, means for maintaining lubricate in said reservoir at an intermediate level on said wall, an elongated cord-like wick having the free end surface at one end disposed in abutting relation with said wall above said level of lubricant and the remainder of the wick extending through said reservoir without contacting the lubricate therein to lubrication distribution points in said operating mechainsm, whereby only the vibratory forces of the frame causes lubricate to wet said wall and through capillary action to wet the wick to distribute lubricate to the operating mechanism.

2. In a sewing machine as recited in claim 1 wherein said one end of the wick is disposed upwardly in abutting relation with the wall.

3. In a sewing machine as recited in claim 2 wherein said distribution points are disposed at an elevation below that of the one end of the wick.

4. In a sewing machine as recited in claim 1 wherein said upstanding wall is disposed at an angle to a line normal to the level of lubricant in the reservoir.

5. In a sewing machine as recited in claim 1 wherein said means for maintaining said lubricant at an intermediate level includes a filler port communicating with said reservoir and a lubricant level gauge.

6. In a sewing machine as recited in claim 1 wherein said reservoir comprises a self-contained modular housing including a mounting flange for securing to the frame, a filler port communicating with the reservoir, and a transparent wall through which the lubricant level can be viewed.

* * * * *